US007896272B2

(12) United States Patent
Frangenberg et al.

(10) Patent No.: US 7,896,272 B2
(45) Date of Patent: Mar. 1, 2011

(54) ROLLER PRESS, IN PARTICULAR FOR INTERPARTICLE COMMINUTION

(75) Inventors: Meinhard Frangenberg, Kürten-Engeldorf (DE); Alexander Hagedorn, Pulheim (DE); Christian Splinter, Pulheim (DE)

(73) Assignee: KHD Humboldt Wedag GmbH, Cologne (DE)

( * ) Notice: Subject to any disclaimer, the term of this patent is extended or adjusted under 35 U.S.C. 154(b) by 140 days.

(21) Appl. No.: 12/162,861

(22) PCT Filed: Jan. 31, 2007

(86) PCT No.: PCT/EP2007/000799

§ 371 (c)(1),
(2), (4) Date: Dec. 2, 2008

(87) PCT Pub. No.: WO2007/088029

PCT Pub. Date: Aug. 9, 2007

(65) Prior Publication Data

US 2009/0314868 A1 Dec. 24, 2009

(30) Foreign Application Priority Data

Jan. 31, 2006 (DE) ..... 10 2006 004 282

(51) Int. Cl.
*B02C 4/02* (2006.01)

(52) U.S. Cl. ..... 241/135; 241/143

(58) Field of Classification Search ..... 241/135, 241/136, 143

See application file for complete search history.

(56) References Cited

U.S. PATENT DOCUMENTS

| | | | |
|---|---|---|---|
| 4,339,083 | A | 7/1982 | Linzberger et al. |
| 4,572,441 | A | 2/1986 | Sangati |

FOREIGN PATENT DOCUMENTS

| | | |
|---|---|---|
| DE | 41 10 643 A1 | 10/1992 |
| DE | 20 2004 001187 | 2/2005 |
| EP | 1201308 | 5/2002 |
| GB | 2137899 | 10/1984 |
| GB | 2347065 | 8/2000 |
| JP | 09 192519 | 7/1999 |

*Primary Examiner*—Mark Rosenbaum
(74) *Attorney, Agent, or Firm*—Greer, Burns & Crain, Ltd.

(57) ABSTRACT

A tandem roller press has two roll pairs which are arranged next to one another in an axially parallel manner in order to provide a roller press system, in particular for the material bed comminution of granular material, which can considerably exceed previous limits with regard to throughput performance but also with regard to the specific energy requirement. Preferably, common feeding of the granular material and common discharge of the material which has been subjected to the material bed comminution are arranged. A tandem separator device may be arranged below the two roll pairs in order to form two parallel compact milling circuits with a high throughput performance overall.

16 Claims, 2 Drawing Sheets

ROLLER PRESS, IN PARTICULAR FOR INTERPARTICLE COMMINUTION

BACKGROUND OF THE INVENTION

The invention relates to a roll machine for the pressure treatment of granular material, in particular a roller press for material bed comminution or compacting and briquetting, having rolls which are mounted rotatably in bearing housings, are driven in opposite directions and are separated from one another by a roll nip, the bearing housings being mounted with their lower and upper sides on sliding tracks of machine brackets, with the use of hydraulic cylinders for pressing one roll against the opposite roll via the material which is situated in the roll nip.

In roll mills for carrying out what is known as material bed comminution, the individual pieces or particles of the milling material which is pulled into the roll nip by friction, such as cement raw material, cement clinker, ores or the like, are pressed into a material bed, that is to say in a bulk which is compressed between the two roll surfaces with the application of a high pressure, and are comminuted against one another, a roller press also being mentioned instead of a roll mill. In known roller presses of this type, see, for example, the brochure "Rollenpressen" [Roller presses] no. 2-300d from KHD Humboldt Wedag AG of September 1994, one of the two rolls is configured as a fixed roll which is supported via its bearing housings against end pieces of the machine frame, while the other roll is supported as a floating roll via its bearing housings on hydraulic cylinders, by way of which the roll pressing force is applied.

Above a defined throughput performance and overall size, known roller presses of this type are complex to manufacture, not least on account of the rolls which become very large and heavy in weight terms, and they can be mounted only with very high expenditure. Therefore, in the case of a required high throughput performance, a bowl-mill roller crusher can be superior, for example, to a roller press for material bed comminution.

SUMMARY OF THE INVENTION

The invention is based on the object of providing a roller press which can considerably exceed previous limits with regard to throughput performance but also with regard to the specific energy requirement.

In the roll machine or roller press according to the invention, a total of two roll pairs are mounted next to one another on the sliding tracks of the machine brackets, that is to say four rolls lie axially parallel with respect to one another, and the two roll pairs correspondingly form two roll nips for the pressure treatment of the charge material. The upper sides of both roll nips are expediently supplied with charge material from a common feed bunker via a material flow divider and two oblique feeding chutes. The material discharge chutes are combined to form a common material discharge means below the roll nips of the two roll pairs, and/or the material discharge chutes of the two roll pairs can also be guided separately to material inlet openings of two separator devices. In the last-mentioned solution, two roll pairs and two separator devices can therefore be combined in a mirror-symmetrical twin design to form a compact machine unit, by way of which the throughput performance of a conventional recirculating grinding mill with a roller press and a separator can be doubled in practice. In this way, high throughput performances can also be achieved as in a bowl-mill roller crusher. In comparison with a bowl-mill roller crusher, there is also the special advantage in the tandem recirculating grinding mill or tandem roller press according to the invention that, if required, the machine unit can be operated further with 50% performance, for example during required maintenance work, by only one half of the machine unit being brought to a standstill, while the other machine half is operated further, and vice versa.

In the roll machine according to the invention, both the investment costs and the spatial requirements are reduced in comparison with the installation of two conventional roller presses, for the reason alone that only a single common machine frame, a single common feed bunker, etc. are required.

Those two rolls of the two roll pairs which lie on the inside and face one another can be configured as a fixed roll, while those two rolls of the two roll pairs which lie on the outside are configured as floating rolls which can be moved transversely with respect to the respective roll nip. In this embodiment of the invention, the hydraulic cylinders which can be pressed onto the bearing housings of the two floating rolls are supported on side parts of the machine frame.

In another embodiment of the invention, the hydraulic cylinders can also be arranged, however, in such a way that, per roll nip, they act in each case both on the bearing housings of one roll and on the bearing housings which lie opposite in each case of the respectively other roll, with the formation of a self-contained system of milling pressing forces without a closed machine frame which is loaded by the radial roll pressing forces. That is to say, the radial milling forces can be absorbed directly via those bearing housings of both rolls which lie opposite one another in each case and are connected to one another, in the case of both roll pairs, with the result that a heavy machine frame is dispensed with. Here, the hydraulic cylinders can be in each case tension cylinders which are arranged transversely with respect to the respective roll nip between the bearing housings which lie opposite one another in each case and pull the bearing housings which lie opposite one another and therefore the two milling rolls per roll pair together. If the hydraulic cylinders are configured here in each case as dual action cylinders, they can be used not only to apply the roll pressing force but also, in the case of reversed loading with pressure medium, to move the two rolls per roll pair apart.

That is to say therefore that all four rolls can be configured particularly advantageously as floating rolls which can be moved transversely with respect to the roll nip, as a result of which all four rolls are loaded equally and uniform wear is produced on the roll surfaces. In order to prevent lateral slipping of the two roll pairs including bearing housings on their sliding tracks of the machine brackets, the rolls can be held by positioning cylinders which are fastened to the machine brackets and can center the roll nip in each case towards the zero position.

The tandem roller press according to the invention is in principle open to the side in each case. Since heavy end pieces of the machine frame are omitted, the rolls can be exchanged, that is to say dismantled and assembled, without lengthy disassembly of the machine frame, for example on the occasion of a repair.

The two separator devices which can be installed below the two roll pairs are advantageously static cascade separators, through which separating air flows and which deagglomerate and separate the roller-press material scabs, it optionally being possible for one dynamic rod-cage separator with a rotating rod cage to be arranged in a manner which adjoins the two static cascade separators.

BRIEF DESCRIPTION OF THE DRAWINGS

The invention and its further features and advantages are explained in greater detail using the exemplary embodiments which are shown diagrammatically in the figures, in which.

DETAILED DESCRIPTION OF THE DRAWINGS

Figure 1:
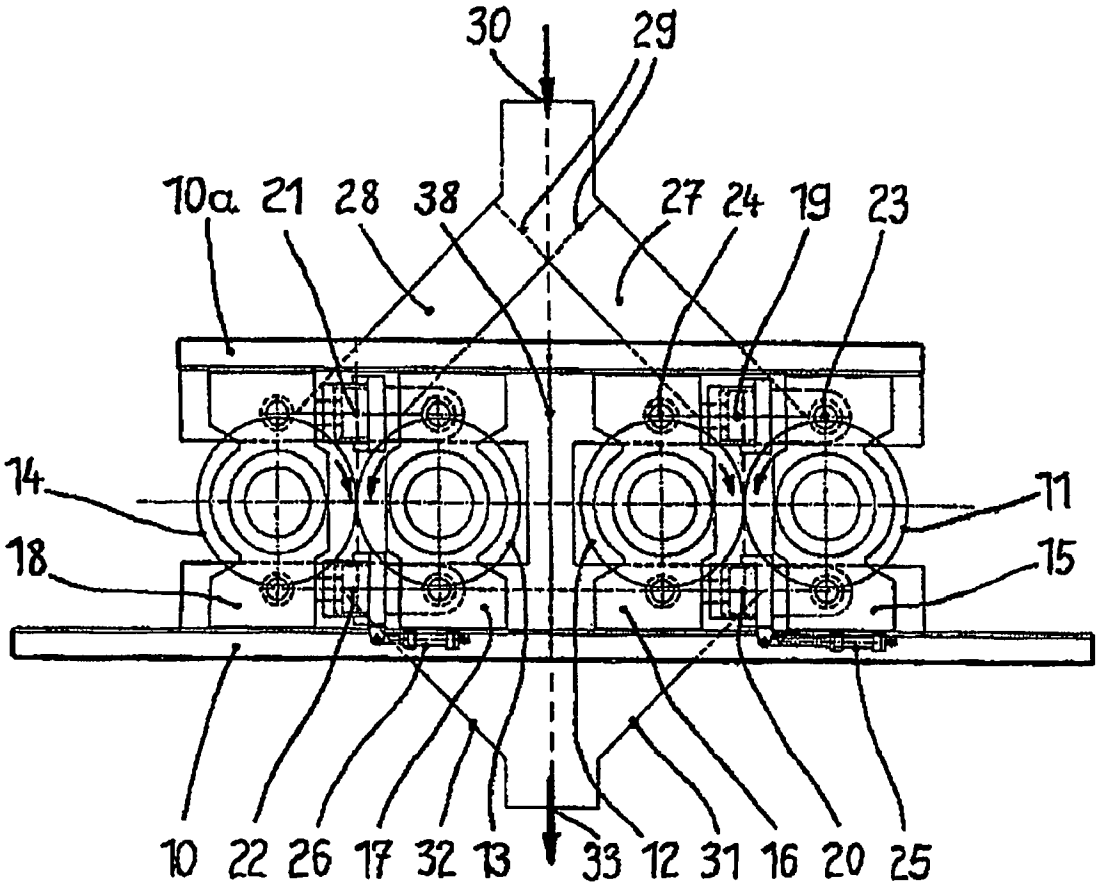
FIG. 1 shows the end view of the tandem roller press according to the invention.

The tandem roller press according to FIG. 1 does not have a closed machine frame for absorbing the roll pressing forces, but rather the frame comprises substantially only two brackets 10 which lie spaced apart transversely with respect to the roll nips and the upper sides of which have flat sliding tracks. There is a right-hand roll pair having the rolls 11 and 12 and a left-hand roll pair having the rolls 13 and 14. All four rolls which are mounted rotatably in an axially parallel manner, are driven in opposite direction and, per roll pair, are separated from one another in each case by a roll nip are configured as rolls which can be moved transversely with respect to the roll nip. The rolls 11, 12 are mounted at their two ends in bearing housings 15 and 16 and, in an analogous manner to this, the rolls 13, 14 are mounted at their two ends in bearing housings 17 and 18, and all the bearing housings are mounted with their lower and upper sides on the sliding tracks of the lower brackets 10 and upper brackets 10*a*.

Figure 2:
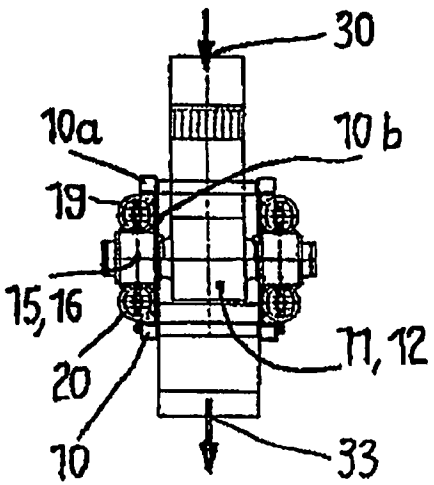
FIG. 2 shows the side view of the roller press of FIG. 1 on a reduced scale.

All four rolls 11 to 14 can therefore slide to and fro translationally with their bearing housings on the sliding tracks of the brackets, transversely with respect to the respectively associated roll nip, the upper sliding track guide of the bearing housings being indicated by the reference numeral 10*a*. The connecting element between the upper and lower brackets 10, 10*a* is indicated by the reference numeral 10*b* in FIG. 2.

According to the exemplary embodiment of FIG. 1, the roll pressing force for pressure loading the material which is to be comminuted and is situated in the two roll nips is applied by way of a total of eight hydraulic cylinders, of which the two hydraulic cylinders 19 and 20 of the right-hand roll pair and the two hydraulic cylinders 21 and 22 of the left-hand roll pair can be seen in the end view of FIG. 1, which connect the front bearing housings directly to one another which lie opposite one another in each case. Both ends 23 and 24 of the upper hydraulic cylinder 19 articulated on or in the bearing housings 15 and 16, etc. which lie opposite one another in each case, precisely as in the case of all other hydraulic cylinders.

The hydraulic cylinders 19, 20 and 21, 22 are arranged in such a way that, per roll pair, they act in each case both on the bearing housings of one roll and on the bearing housings which lie opposite in each case of the other roll, with the formation in each case of a self-contained system of milling pressing forces, with the result that a heavy machine frame which is loaded with the roll pressing forces can be omitted. If the hydraulic tension cylinders 19, 20 and 21, 22 are loaded with pressure medium in the opposite direction, that is to say if they are configured as dual action cylinders, the cylinders can also be used to move the rolls of the two roll pairs apart.

Figure 3:
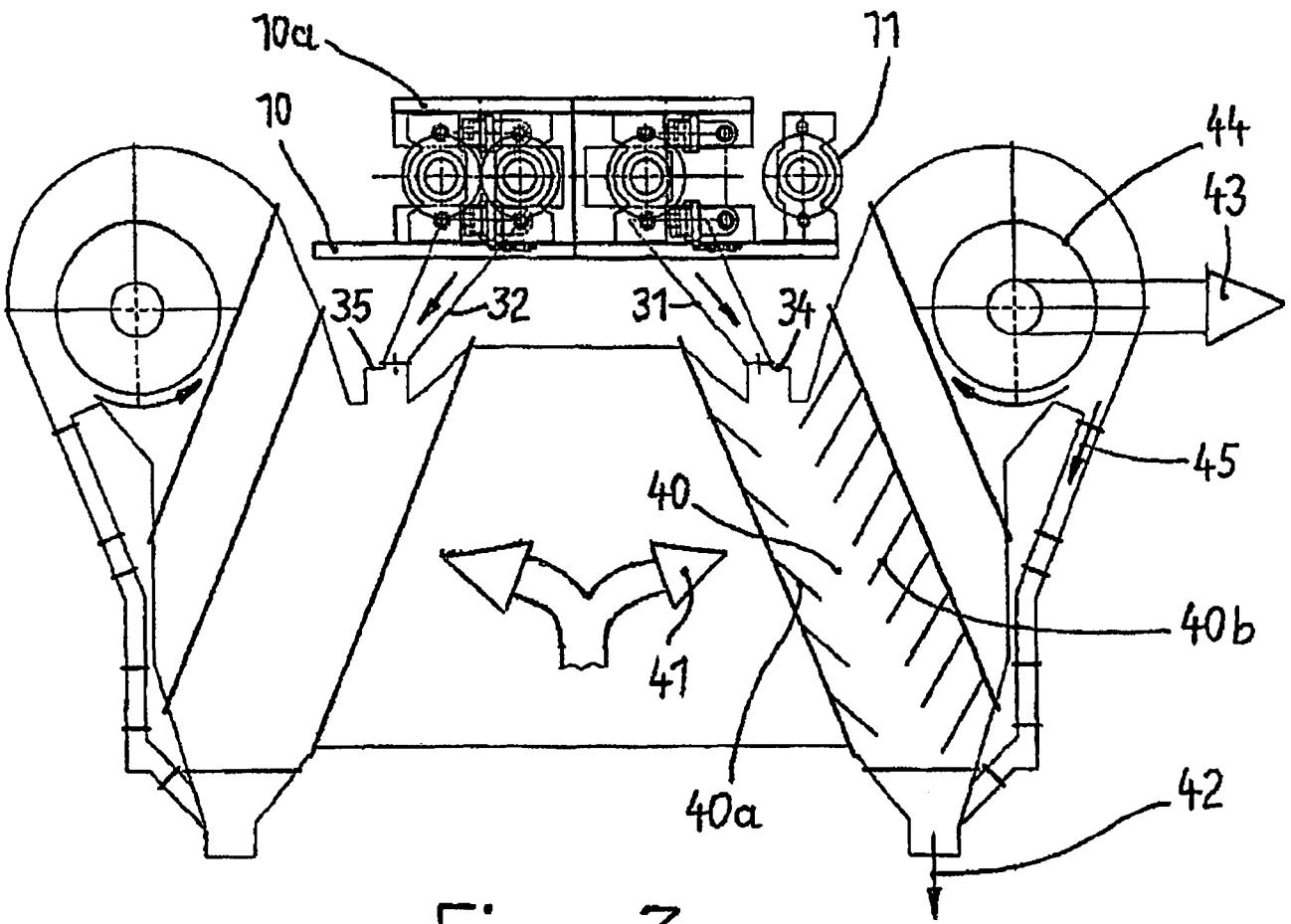
FIG. 3 shows an end view/side view of the tandem roller press with a tandem separator device arranged below it, as part of tandem grinding recirculation systems.

Moreover, FIG. 1 makes it clear that, in the tandem roller press according to the invention, at least those rolls of the two roll pairs which lie in each case on the outside can be pulled outwards on the brackets 10 together with the bearing housings, that is to say can be pulled out to the right-hand side and to the left-hand side without being impeded by a machine frame. FIG. 3 shows the roll 11 together with the bearing housings in the pulled-out position.

In order that the two roll pairs cannot slip laterally with their bearing housings on the sliding tracks of the brackets 10, 10*a*, both roll pairs are held by positioning cylinders 25 and 26 which are fastened to the machine brackets 10 and act on the cylinder tubes of the hydraulic cylinders 20 and 22 or on another suitable component of the system, in order for it to be possible for the two roll pairs to be centered with regard to the zero position by actuation of the positioning cylinders 25 and 26, even during machine operation. At the same time, the positioning cylinders 25 and 26 which assume a control function can be hydropneumatic damping components for damping the jolts and vibrations which are produced during machine operation.

Two material feeding chutes 27 and 28 are arranged above the roll nips of the two roll pairs, which two material feeding chutes 27 and 28 are connected via an adjustable material flow divider 29 to a common material inlet 30, via which the two roll nips are supplied from a common bunker with material which is to be comminuted. In the case of necessary maintenance work on one of the two roll pairs, the respective material flow can even be interrupted completely at the material flow divider 29, while the other roll pair operates further.

The tandem roller press according to the invention is of compact construction despite the presence of four axially parallel rolls. The axial spacing between the inner rolls 12 and 13 is therefore only the size of the roll diameter plus an addition of, for example, 0.5 meter. In comparison with this, the axial spacing if two conventional roller presses were installed next to one another would be the size of the roll diameter plus approximately at least 4 meters. In order to protect the working space, a vertical central dividing wall 38 can be arranged between the two roll presses 11/12 and 13/14.

According to FIG. 1, the material discharge chutes 31 and 32 are guided to a common material discharge means 33 for discharging the material scabs below the roll nips of the two roll pairs.

According to FIG. 3, the material discharge chutes 31, 32 which are arranged below the roll nips of the two roll pairs can remain separate and can be guided to the material inlet openings 34 and 35 of two separator devices. In the exemplary embodiment of FIG. 3, the two separator devices comprise in each case a static cascade separator, having two separating-zone delimiting walls which form a separating zone 40 between them, are flowed through by separating air 41 or by hot gas as drying gas approximately in a transverse flow, and have guide plates 40*a* and 40*b* which are inclined obliquely downwards for the discharge of the separated coarse-grained fraction 42 and are arranged in the manner of a cascade or louvers, these two guide-plate walls and therefore the separating zone 40 which lies between them being arranged so as to lie obliquely at an angle which deviates from the vertical.

The separating air which flows in via a common separating-air inflow housing is divided onto the right-hand separating-air part flow 41 and in the same way to a left-hand separating-air part flow, and is fed to the respective separator device. The cascade separators which are flowed through by the separating air act as deagglomerators for the material scabs which are discharged from the tandem roller press and are fed at the top to the two cascade separators, optionally with milling material which is still fresh. In any case, the separating air 41 separates the fine material fraction from the separating material, and the separating air which is loaded with fine material 43 is extracted from the milling circulation via a line which is guided out through one or both side walls, while the coarse grain fraction 42 which is separated in each case from the separating material by the cascade separator is recirculated to the respective roll pair of the tandem roller press and is subjected to further material bed loading.

A dynamic rod-cage separator with a rotating rod cage 44 can be arranged in a manner which adjoins in each case the static cascade separator, having at least one discharge elbow for withdrawing the separating air which is loaded with the fine material 43. The fine material 43 is then separated from the separating air outside the recirculating grinding mill. A medium grain fraction 45 can be extracted at the periphery of the rotating rod cage 44, which medium grain fraction 45 can likewise be recirculated to the material inlet of the roller presses together with the coarse grain fraction 42. The dynamic rod-cage separators with their rod cages 44 which are used as a further separator to the cascade separators can also be arranged above the tandem roller press as is known in principle from DE 102 21 739 A1.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A roll machine for the pressure treatment of granular material, having rolls which are mounted rotatably in bearing housings, are driven in opposite directions and are separated from one another by a roll nip, the bearing housings being mounted with their lower and upper sides on sliding tracks of machine brackets, with the use of hydraulic cylinders for pressing one roll against the opposite rolls via the material which is situated in the roll nip, the roll machine further comprising:

two roll pairs having in each case one roll nip being mounted next to one another on the sliding tracks of the machine brackets;

two material feeding chutes which are connected to a common material inlet via a material flow divider being arranged above the roll nips of the two roll pairs; and material discharge chutes being arranged below the roll nips of the two roll pairs are guided to one of a common material discharge device or to material inlet openings of two separator devices.

2. A roll machine according to claim 1, wherein the two roll pairs are arranged back-to-back such that two of the rolls are arranged on the inside and two of the rolls are arranged on the outside, such that the two rolls which lie on the inside and face one another are configured as a fixed roll, while the two rolls which lie on the outside are configured as floating rolls which can be moved transversely with respect to the respective roll nip.

3. A roll machine according to claim 2, wherein hydraulic cylinders which can be pressed onto the bearing housings of the two floating rolls are supported on side parts of the machine frame.

4. A roll machine according to claim 1, including a vertical central dividing wall arranged between the two roll pairs, the two roll pairs lying symmetrically on both sides of said dividing wall.

5. A roll machine according to claim 1, wherein the two roll pairs are arranged back-to-back such that two of the rolls are arranged on the inside and two of the rolls are arranged on the outside, and an expansion of the roll nip for each of the two roll pairs takes place to the outside towards the corresponding sides transversely with respect to the respective roll nip.

6. A roll machine according to claim 1 including two separator devices arranged below the two roll pairs which are static cascade separators, through which separating air flows and which deagglomerate and separate roller-press material scabs.

7. A roll machine according to claim 6, including a dynamic rod-cage separator with a rotating rod cage arranged to adjoin each of the two static cascade separators.

8. A roll machine for the pressure treatment of granular material, comprising:

rolls mounted rotatably in bearing housings, the rolls being driven in opposite directions by a motor, the rolls being separated from one another by a roll nip, the bearing housings being mounted with lower and upper sides on sliding tracks of machine brackets and being arranged to slide to and fro translationally, transversely with respect to the roll nip, hydraulic cylinders arranged to press one roll against an opposite roll via the granular material which is situated in the roll nip, the rolls comprising two roll pairs, each pair having one roll nip, the two pairs of rolls being mounted next to one another on the sliding tracks of the machine brackets;

two material feeding chutes connected to a common material inlet via a material flow divider being arranged above the roll nips of the two roll pairs; and material discharge chutes being arranged below the roll nips of the two roll pairs to guide discharge material to one of a common material discharge device or material inlet openings of two separator devices.

9. A roll machine according to claim 8, wherein the two roll pairs are arranged back-to-back such that two of the rolls are arranged on the inside and two of the rolls are arranged on the outside, such that the two rolls which lie on the inside and face one another are configured as fixed rolls, while the two rolls which lie on the outside are configured as floating rolls which can be moved transversely with respect to the respective roll nip.

10. A roll machine according to claim 9, wherein hydraulic cylinders are supported on side parts of the machine frame to press onto the bearing housings of the two floating rolls.

11. A roll machine according to claim 10, wherein the hydraulic cylinders are arranged in such a way that, per roll nip, they act in each case both on bearing housings of one roll and on the bearing housings which lie opposite in each case of the respectively other roll, with the formation of a self-contained system of milling pressing forces without a closed machine frame which is loaded by the radial roll pressing forces.

12. A roll machine according to claim 8, including a vertical central dividing wall arranged between the two roll pairs, the two roll pairs lying symmetrically on both sides of said dividing wall.

13. A roll machine according to claim 8, wherein the two roll pairs are arranged back-to-back such that two of the rolls are arranged on the inside and two of the rolls are arranged on the outside, and an expansion of the roll nip for each of the two roll pairs takes place to the outside towards the corresponding sides transversely with respect to the respective roll nip.

14. A roll machine according to claim 8 including two separator devices arranged below the two roll pairs which are static cascade separators, through which separating air flows and which deagglomerate and separate roller-press material scabs.

15. A roll machine according to claim 14, including a dynamic rod-cage separator with a rotating rod cage arranged to adjoin each of the two static cascade separators.

16. A roll machine for the pressure treatment of granular material, having rolls which are mounted rotatably in bearing housings, are driven in opposite directions and are separated from one another by a roll nip, the bearing housings being mounted with their lower and upper sides on sliding tracks of machine brackets, with the use of hydraulic cylinders for pressing one roll against the opposite rolls via the material which is situated in the roll nip, the roll machine further comprising:

two roll pairs having in each case one roll nip being mounted next to one another on the sliding tracks of the machine brackets;

two material feeding chutes which are connected to a common material inlet via a material flow divider being arranged above the roll nips of the two roll pairs; and material discharge chutes being arranged below the roll nips of the two roll pairs are guided to one of a common material discharge device or to material inlet openings of two separator devices, wherein the hydraulic cylinders are arranged in such a way that, per roll nip, they act in each case both on bearing housings of one roll and on the bearing housings which lie opposite in each case of the respectively other roll, with the formation of a self-contained system of milling pressing forces without a closed machine frame which is loaded by the radial roll pressing forces.

* * * * *